US007413794B2

(12) United States Patent
Shigemura

(10) Patent No.: US 7,413,794 B2
(45) Date of Patent: Aug. 19, 2008

(54) TRANSFER MATERIAL

(75) Inventor: Kiyohito Shigemura, Kyoto (JP)

(73) Assignee: Nissha Printing Co., Ltd, Kyoto (JP)

( * ) Notice: Subject to any disclaimer, the term of this patent is extended or adjusted under 35 U.S.C. 154(b) by 309 days.

(21) Appl. No.: 10/530,345

(22) PCT Filed: Oct. 6, 2003

(86) PCT No.: PCT/JP03/12760

§ 371 (c)(1),
(2), (4) Date: Apr. 6, 2005

(87) PCT Pub. No.: WO2004/030936

PCT Pub. Date: Apr. 15, 2004

(65) Prior Publication Data

US 2006/0068135 A1 Mar. 30, 2006

(30) Foreign Application Priority Data

Oct. 7, 2002 (JP) ..... 2002-293374
Oct. 7, 2002 (JP) ..... 2002-293375

(51) Int. Cl.
*B41M 5/00* (2006.01)

(52) U.S. Cl. ..... 428/195.1; 428/204; 428/32.6; 428/32.79; 428/32.81; 428/44; 428/213; 428/448; 428/161; 428/172

(58) Field of Classification Search ..... 428/325, 428/195, 195.1, 206, 210, 913, 914, 204, 428/32.6, 32.79, 32.81, 213, 448, 44, 161, 428/172

See application file for complete search history.

(56) References Cited

U.S. PATENT DOCUMENTS 5,480,503 A * 1/1996 Casey et al. ..... 156/89.18
6,207,268 B1 * 3/2001 Kosaka et al. ..... 428/325

FOREIGN PATENT DOCUMENTS

| | | | |
|---|---|---|---|
| JP | 03-243399 | | 10/1991 |
| JP | 4-45799 | | 4/1992 |
| JP | 09-030197 | | 2/1997 |
| JP | 10-016497 | | 1/1998 |
| JP | 11-058584 | | 3/1999 |
| JP | 11058584 | * | 3/1999 |
| JP | 2000-085299 | | 3/2000 |
| JP | 2000-108594 | | 4/2000 |

* cited by examiner

*Primary Examiner*—Bruce H. Hess
*Assistant Examiner*—Tamra L Dicus
(74) *Attorney, Agent, or Firm*—Wenderoth, Lind & Ponack, L.L.P.

(57) ABSTRACT

A transfer member includes a substrate sheet, a mold release layer of a belt-shaped pattern laminated on the substrate sheet, an ionizing radiation curing layer laminated all over a surface on mold release layer, a patterned layer laminated all over a surface or partially on the ionizing radiation curing layer, and an adhesive layer laminated on the patterned layer only partially in a portion where the adhesive layer overlaps with the mold release layer.

10 Claims, 10 Drawing Sheets

*Fig.4* - PRIOR ART
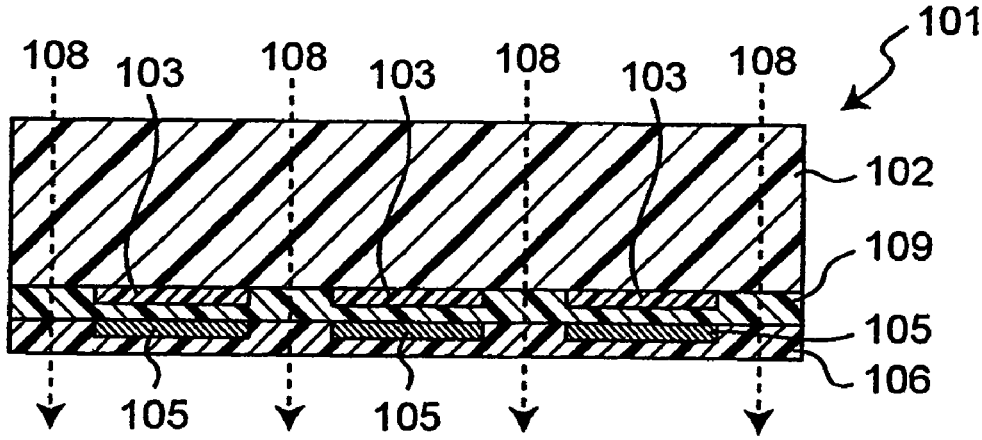
*Fig.5* - PRIOR ART
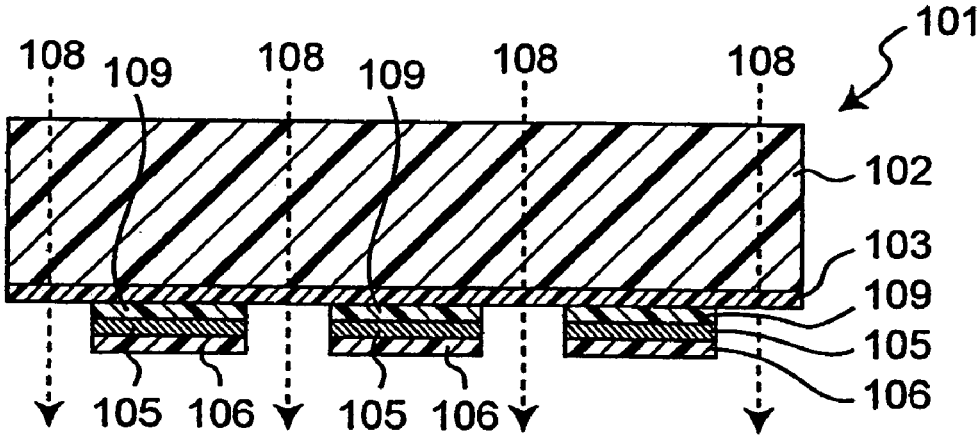

*Fig. 10* - PRIOR ART
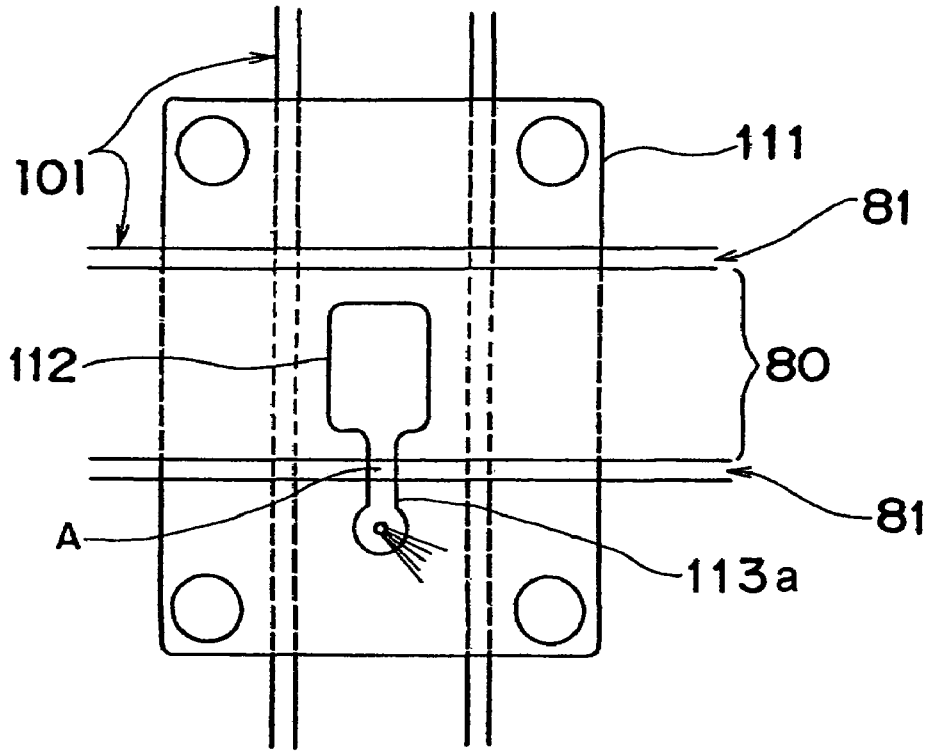
*Fig. 11* - PRIOR ART
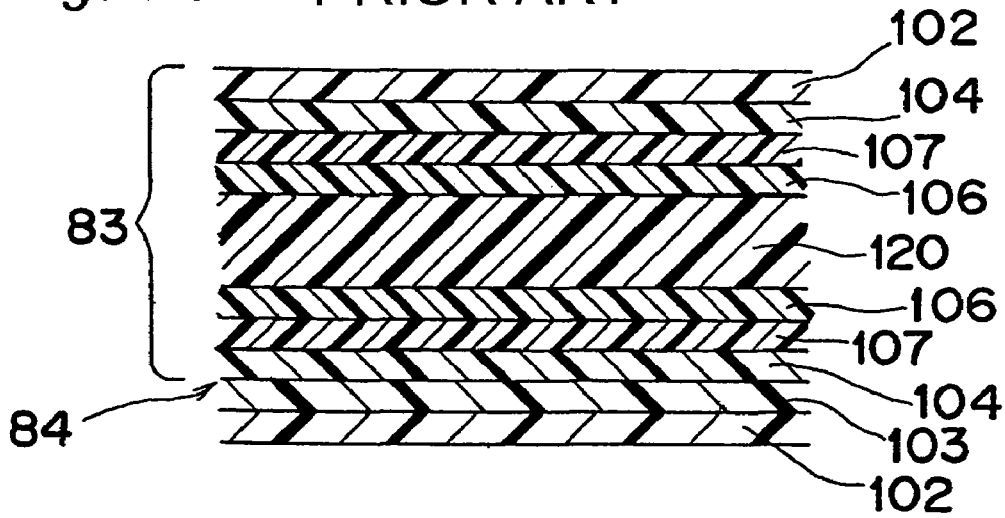

*Fig. 12* - PRIOR ART
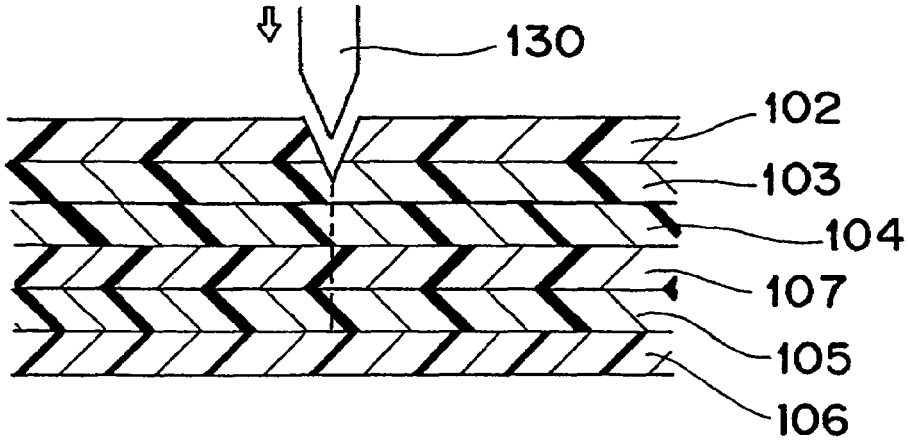
*Fig. 13* - PRIOR ART
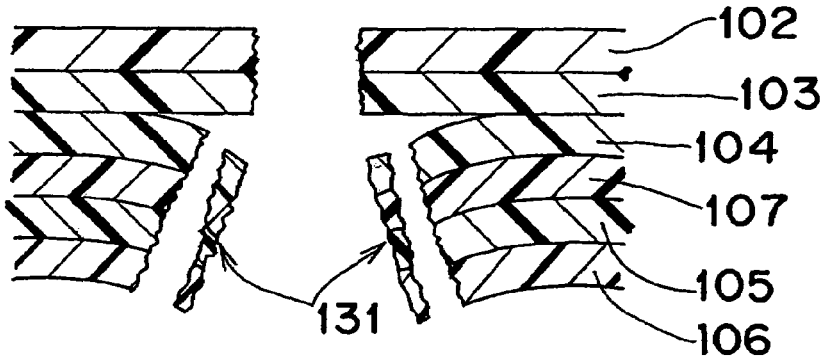
*Fig. 14*
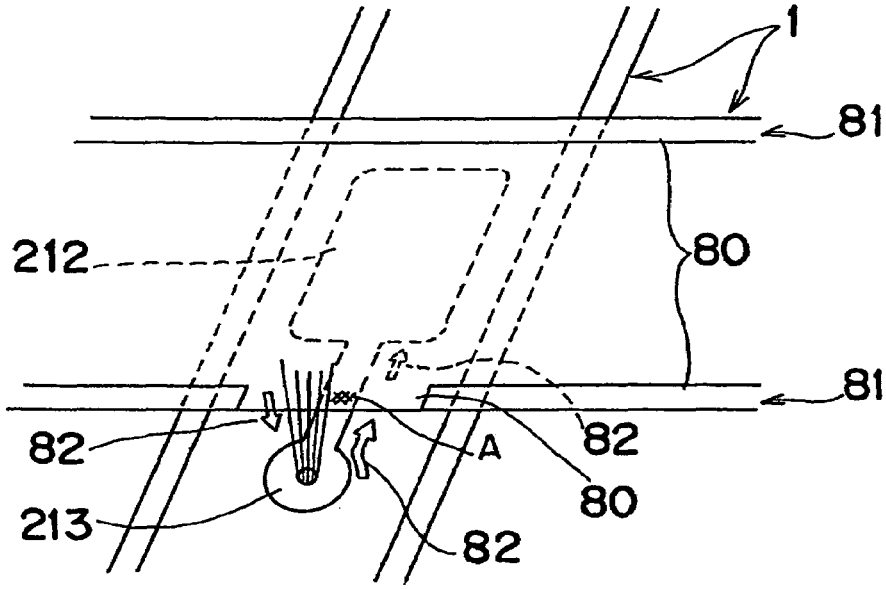

TRANSFER MATERIAL

TECHNICAL FIELD

The present invention relates to a transfer member for use in decorating the surface of a resin molded article.

BACKGROUND ART

Conventionally, as a method for decorating the surface of a resin molded article, there has been a method of transfer simultaneous with molding. The method of transfer simultaneous with molding is a method for providing decoration by placing, in a metal mold, a transfer member having transfer layers including a release layer, a patterned layer, an adhesive layer, and so on are laminated in order on a substrate sheet injecting and stuffing a resin into a cavity, making the transfer member adhere to a surface of a resin molded article simultaneously with obtaining the resin molded article by cooling, and thereafter peeling off the substrate sheet and transferring the transfer layers onto the surface of the resin molded article.

In general, the transfer member used for the method of transfer simultaneous with molding is formed by printing the layers on an elongated substrate sheet in accordance with the width of the roll of a printing machine and used by being cut (slit) into an appropriate width in accordance with the size of an object to receive transfer (object to which transfer layers of the transfer member are to be transferred), and thereafter transferred.

In this case, there has been a drawback of the occurrence of a foil flaking phenomenon in which ink film flakes 131 constituted of a peel layer 104, an anchor layer 107, a patterned layer 105, an adhesive layer 106, and so on peel off the surface of a mold release layer 103 formed on the substrate sheet 102 at the slit portion of the transfer member which is caused by an impact occurring when the blade 130 hits at the time of slitting as shown in FIGS. 12 and 13. This is because not only the portion subjected to transfer but also the portion that is not subjected to transfer have excellent peelability between the substrate sheet and the transfer layers of the transfer member. The foil flaking has occurred more significantly as the thickness of the transfer layers is increased as in the case where there are many patterned layers as transfer layers, in the case where a vapor deposition layer is required to be provided as a patterned layer, in the case where the peel layer cannot help being thick as in the case of a hard coat transfer member, in the case where there is many function layers, and in similar cases.

As a result, it has occasionally been the case where the ink film flakes have adhered again to the transfer member and entered between the object and the transfer layers during transfer. Furthermore, carrying out the transfer simultaneous with molding with an ink film flake adhered to the back surface of the transfer member has caused the adhesion of the ink film flakes to the cavity surfaces of the metal mold, occasionally causing a dint (called a dent) due to the ink film flake on the surface of the molded article.

Accordingly, there is a transfer member in which the mold release layer 103 is provided in a belt-like pattern excluding a portion to be brought in contact with a slit portion 108 when the mold release layer 103 is provided on a substrate sheet, and in which transfer layers including a peel layer 109, a patterned layer 105, an adhesive layer 106, and so on are provided on the mold release layer 103 in order to prevent the occurrence of foil flaking during slitting (refer to FIG. 4 and Unexamined Japanese Patent Publication No. 11-58584).

Moreover, it can be considered to provide all the transfer layers in a pattern instead of providing the mold release layer 103 all over the surface and constitute the transfer member 101 so that the slit blade does not come in contact with the transfer layers during slitting (see FIG. 5).

However, there has been an issue that, when a metal mold 111 having a side gate 113 is used in the case where the transfer simultaneous with molding is carried out by using the transfer member 101 of the construction shown in FIG. 4, a runner portion 113*a* for the molding resin communicating with a cavity 112 as shown in FIG. 10 is brought in contact with the neighborhood of the slit portion 108 of the transfer member 101 (Note that in FIG. 10, reference numeral 80 denotes a region where the mold release layer 103 is provided, and 81 denotes a region where the mold release layer 103 is not provided), and the sprue runner for the molding resin fuses to the adhesive layer 106 of the transfer member 101 (as shown in FIG. 11, in an injection molding state, a portion for peeling-off is only a portion 84 which is an interface of the mold release layer 103 and the peel layer 104 for peeling-off after transfer, and peeling-off can not be performed at the other portion, and there is provided the adhesive layer 106 on the sprue runner side of the molding resin portion 120, there is no peel portion on this side, and thus the sprue runner for the molding resin fuses to the adhesive layer 106), failing in carrying out continuous molding as a consequence of the break of the transfer member 101 or other trouble (see FIG. 6). Particularly when carrying out the transfer simultaneous with molding on both sides of the molded article by using two transfer members 101 as shown in FIG. 10, the molding resin flows in contact with the edge portion of either transfer member 101, and therefore, the aforementioned phenomenon occurs more easily.

Moreover, in the transfer member of the construction shown in FIG. 5, an ionizing radiation curing resin is used as the peel layer 109 when the surface strength of the transfer molded article is desired to be improved. However, the thickness of the ionizing radiation curing resin has been limited when formed by being partially patterned by a printing method, and this therefore has led to an issue that a sufficient surface strength has not been able to be obtained.

Accordingly, the object of the present invention is to solve the aforementioned issues and provide a transfer member capable of being continuously formed by a method of transfer simultaneous with molding and obtaining a molded article having excellent surface strength.

DISCLOSURE OF INVENTION

In order to achieve the aforementioned object, the present invention is constructed as follows.

According to a first aspect of the present invention, there is provided a transfer member comprising:

a substrate sheet;

a mold release layer of a belt-shaped pattern laminated on the substrate sheet;

an ionizing radiation curing layer laminated all over a surface on the mold release layer;

a patterned layer laminated all over a surface or partially on the ionizing radiation curing layer; and an adhesive layer laminated on the patterned layer only partially in a portion where the adhesive layer overlaps with (is superposed over) the mold release layer.

According to a second aspect of the present invention, there is provided the transfer member according to the first aspect, wherein the adhesive layer is laminated in a region narrower along a direction of width of the transfer member than a region where the adhesive layer overlaps with the mold release layer.

According to a third aspect of the present invention, there is provided the transfer member according to the first or second aspect, wherein, after being bonded to a resin board, the transfer member has a peel strength smaller than 50 N/m with respect to the resin board in a portion where the mold release layer is not provided when the transfer member is peeled off at an angle of 90° with respect to the resin board.

According to a fourth aspect of the present invention, there is provided the transfer member according to the first or second aspect, further comprising: an anchor layer laminated wholly or partially between the ionizing radiation curing layer and the patterned layer.

According to a fifth aspect of the present invention, there is provided a he transfer member according to the third aspect, further comprising: an anchor layer laminated wholly or partially between the ionizing radiation curing layer and the patterned layer.

According to a sixth aspect of the present invention, there is provided the transfer member according to the first aspect, wherein the patterned layer is laminated wholly or partially on the ionizing radiation curing layer, the adhesive layer is laminated wholly instead of partially on the patterned layer, and the transfer member further comprises a nonadhesive layer laminated on the adhesive layer at least partially in a portion where the nonadhesive layer does not overlap with the mold release layer.

According to a seventh aspect of the present invention, there is provided a transfer member according to the third aspect, wherein the patterned layer is laminated wholly or partially on the ionizing radiation curing layer, the adhesive layer is laminated wholly instead of partially on the patterned layer, and the transfer member further comprises a nonadhesive layer laminated on the adhesive layer at least partially in a portion where the nonadhesive layer does not overlap with the mold release layer.

According to an eighth aspect of the present invention, there is provided a transfer member according to the fourth aspect, wherein the patterned layer is laminated wholly or partially on the ionizing radiation curing layer, the adhesive layer is laminated wholly instead of partially on the patterned layer, and the transfer member further comprises a nonadhesive layer laminated on the adhesive layer at least partially in a portion where the nonadhesive layer does not overlap with the mold release layer.

According to a ninth aspect of the present invention, there is provided a transfer member according to the fifth aspect, wherein the patterned layer is laminated wholly or partially on the ionizing radiation curing layer, the adhesive layer is laminated wholly instead of partially on the patterned layer, and the transfer member further comprises a nonadhesive layer laminated on the adhesive layer at least partially in a portion where the nonadhesive layer does not overlap with the mold release layer.

BRIEF DESCRIPTION OF DRAWINGS

These and other aspects and features of the present invention will become clear from the following description taken in conjunction with the preferred embodiments thereof with reference to the accompanying drawings, in which:

FIG. 4 is a sectional view showing one example of a conventional transfer member;

FIG. 5 is a sectional view showing another example of a conventional transfer member;

FIG. 10 is a view showing a relation between the conventional transfer member and a metal mold;

FIG. 11 is a sectional view of the conventional transfer member at a portion A in FIG. 10;

FIG. 12 is an explanatory view for explaining a state where slitting is performed at a slit portion of the conventional transfer member;

FIG. 13 is an explanatory view for explaining a foil flaking phenomenon;

FIG. 14 is a plan view showing a relation between a transfer member of the present invention and the metal mold;

DETAILED DESCRIPTION OF THE INVENTION

Figure 1:
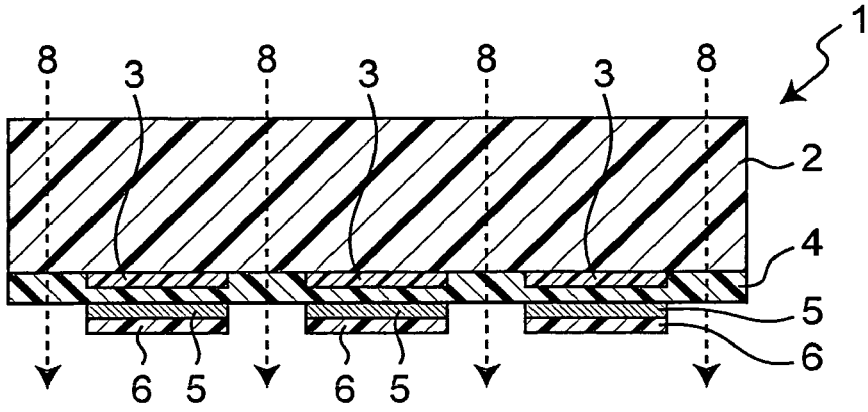
FIG. 1 is a sectional view showing a transfer member of a first embodiment of the present invention.

Before the description of the present invention proceeds, it is to be noted that like parts are designated by like reference numerals throughout the accompanying drawings.

Figure 2:
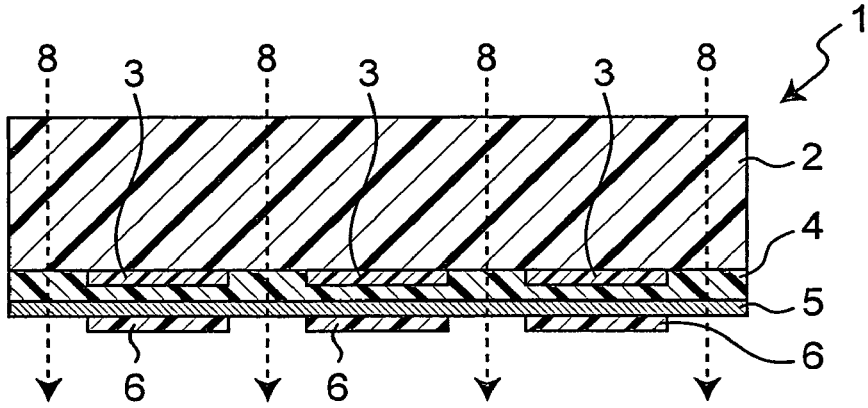
FIG. 2 is a sectional view showing the transfer member of a modification of the first embodiment of the present invention.
Figure 3:
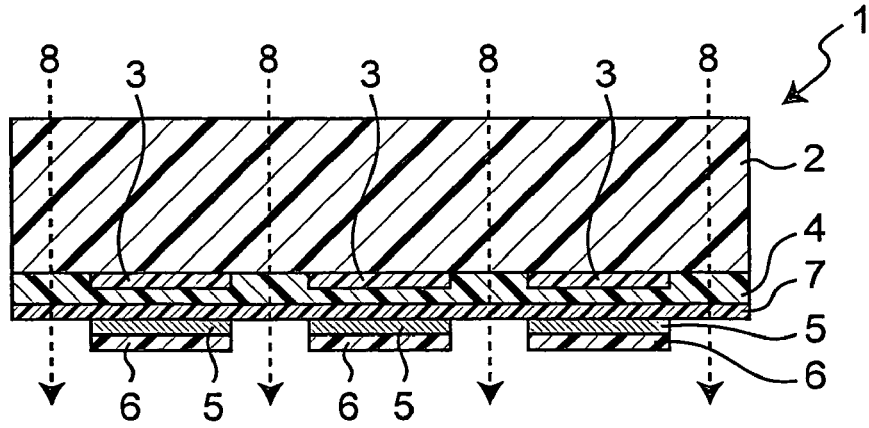
FIG. 3 is a sectional view showing the transfer member of another modification of the first embodiment of the present invention.
Figure 6:
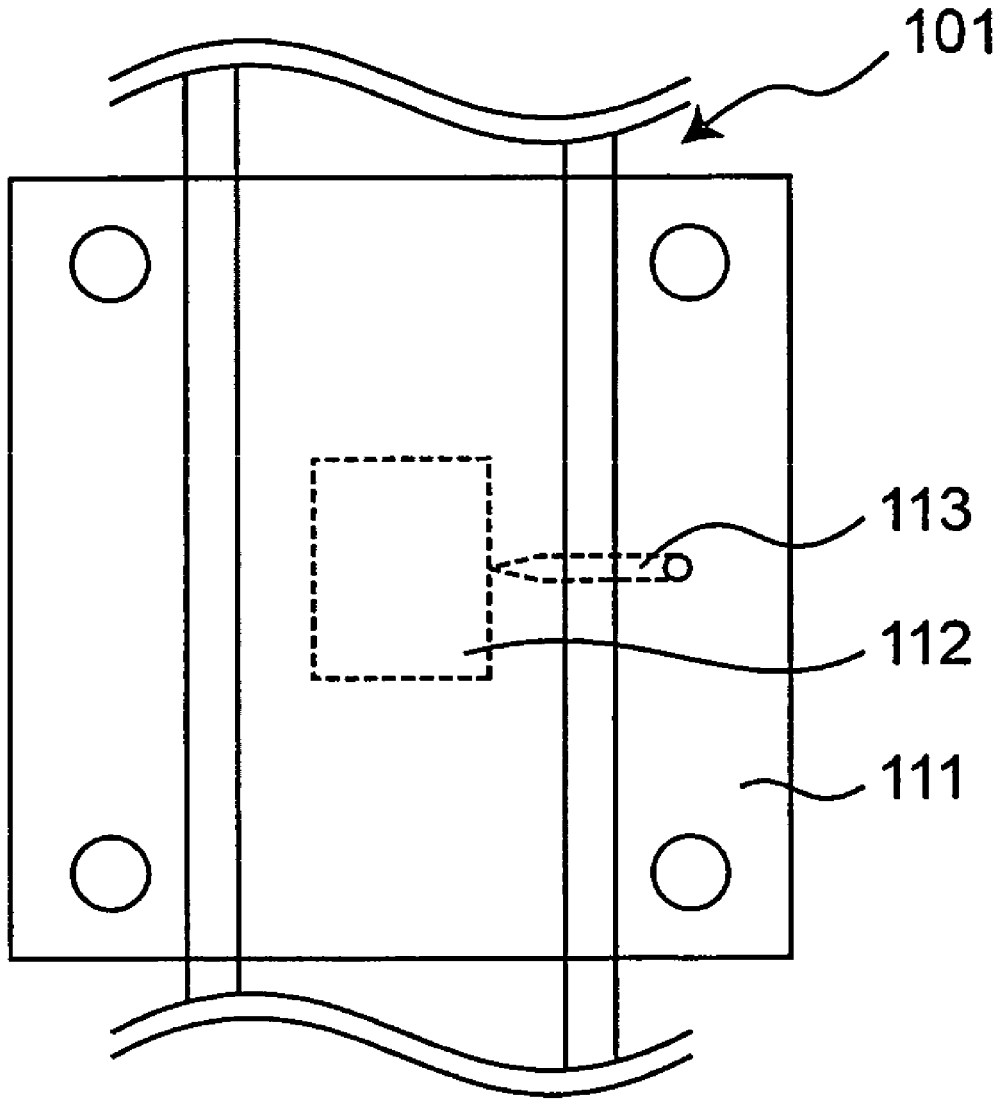
FIG. 6 is a schematic view showing the case where transfer simultaneous with molding is executed by using a conventional transfer member.

FIGS. 1 through 3 are sectional views showing transfer members of a first embodiment of the present invention and its modifications. In the figures, reference numeral 1 denotes a transfer member, 2 denotes a substrate sheet, 3 denotes a mold release layer provided on the substrate sheet 2, 4 denotes an ionizing radiation curing layer provided on the substrate sheet 2 and the mold release layers 3, 5 denotes a patterned layer provided on the ionizing radiation curing layer 4, 6 denotes an adhesive layer provided on the patterned layer(s) 5, 7 denotes an anchor layer provided between the ionizing radiation curing layer 4 and the patterned layer(s) 5, and 8 denotes a slit portion.

The transfer member 1 is laminated with the mold release layers 3 of belt-shaped patterns, laminated with the ionizing radiation curing layer 4 all over the surface, laminated with the patterned layer(s) 5 all or partially over the surface and laminated with the adhesive layers 6 only where the adhesive layers 6 will overlap with the mold release layers 3. After being bonded to a resin board, the transfer member 1 has a peel strength smaller than 50 N/m with respect to the resin board in the portions where the mold release layers 3 are not provided when the transfer member 1 is peeled off at an angle of 90° with respect to the resin board (see FIGS. 1 through 3).

It is preferable to use an elongated sheet as the substrate sheet 2. As a material for the substrate sheet 2, there can be employed a resin sheet of a single body or a copolymer of a polyethylene based resin such as a polyethylene terephthalate resin, an acrylic resin, a polyvinyl chloride based resin, a polypropylene based resin, a polyester based resin, and a polyamide based resin or the like, a metal foil such as an aluminum foil and a copper foil, a cellulose based sheet such as glassine paper, coated paper or cellophane, or a complex of the above-mentioned sheets. Moreover, when the surface of the substrate sheet 2 has minute undulations, the undulations are transferred onto the transfer layers, so that matted, hairline and other surface configurations can be expressed. Moreover, there may be provided a surface treatment of easy bonding or the like. The easy bonding treatment is the processing for making the ionizing radiation curing layer 4 adhere closely to the substrate sheet 2 so that the ionizing radiation curing layer 4 does not peel off the substrate sheet 2 when the transfer member 1 is slit so as to have a width appropriate for transfer. As the easy bonding treatment method, there are included, for example, a corona treatment method for roughening the surface of the substrate sheet 2 to facilitate close adhesion, a method for providing an anchor coating on the surface of the substrate sheet 2 during its manufacturing, and so on.

Figure 19:
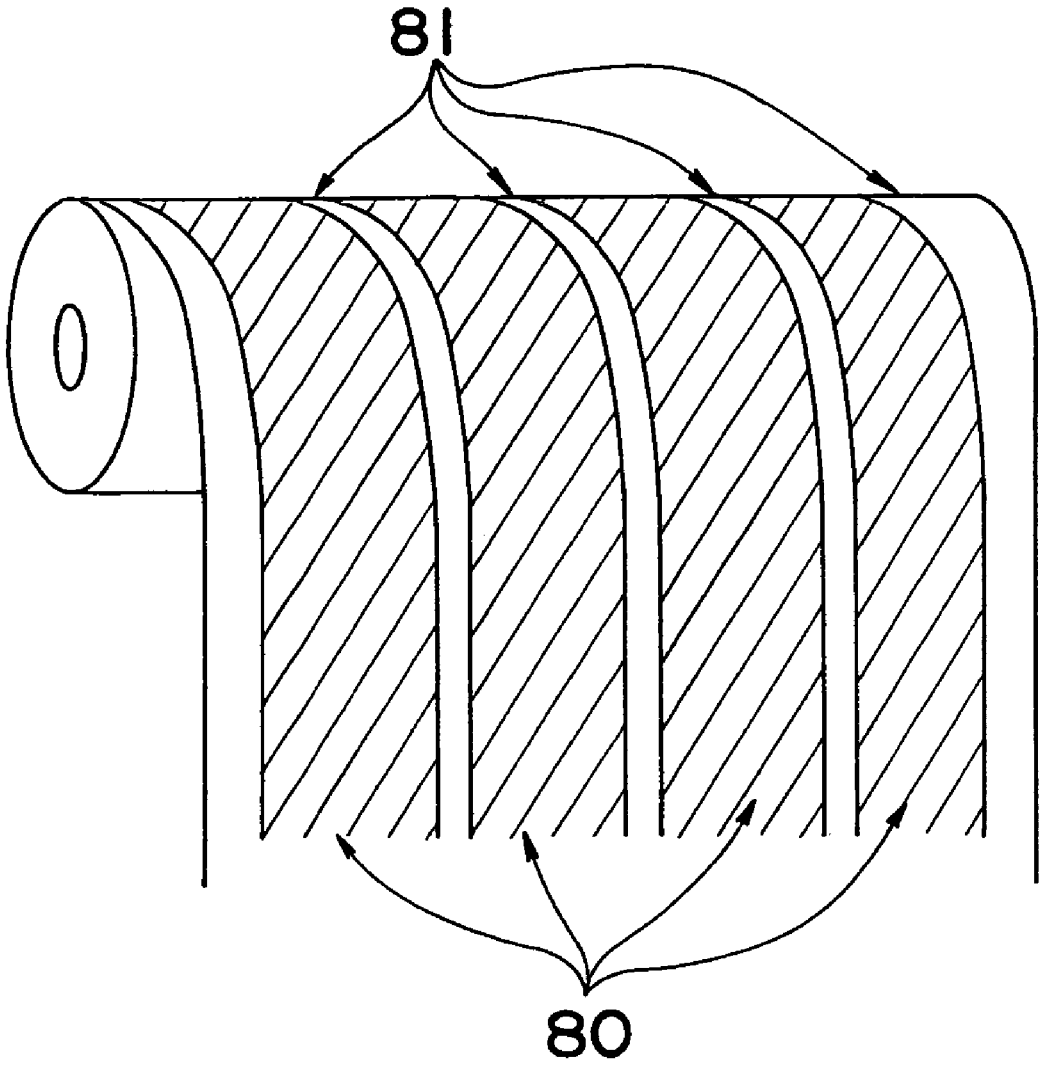
FIG. 19 is a perspective view of the transfer member of an embodiment of the present invention in which four belt-like pattern peeling layers are provided.

Here, the reason why the transfer member is slit is that, as compared to a case where the transfer member is printed on a substrate sheet of the necessary width, 1) the production efficiency is better when the slitting is carried out after the transfer members of necessary width are arranged and printed on the substrate sheet of a great width (the amount of products produced in a short time is large) as shown in FIG. 19; and 2) in terms of ordering and managing the substrate sheet, it is advantageous to fix the width of the substrate sheet to be constant, and moreover, there is no need to change the setting of the printing machine according to the width of the substrate sheet during printing.

The mold release layer 3 is a layer for mold release together with the substrate sheet 2 from the ionizing radiation curing layer 4 when the substrate sheet 2 is peeled off after transfer or transfer simultaneous with molding and is partially formed in a belt-shaped pattern on the substrate sheet 2. When the substrate sheet 2 is elongated, one or a plurality of belt-shaped patterns constructed of the mold release layers 3 are formed so as to become parallel to the longer side of the substrate sheet 2. Since the transfer member 1 is slit in a portion between mutually adjacent mold release layers 3 when there is a plurality of mold release layers 3, it is proper to form the mold release layers 3 of a width of about 5 to 10 mm.

As a material for the mold release layer 3, there can be employed a melamine resin based mold release agent, a silicone resin based mold release agent, a fluororesin based mold release agent, a cellulose derivative based mold release agent, a urea resin based mold release agent, a polyolefin resin based mold release agent, a paraffin based mold release agent, or a mold release agent that is a composite of these substances. Moreover, it is acceptable to use a mold release agent mixed with particles of silicone or the like as needed in order to form minute undulations on the surface of transfer. As a method for forming the mold release layer 3, there are printing methods including the gravure printing method and the screen printing method.

The ionizing radiation curing layer 4 is the one that becomes the outermost layer of the resin molded article after the substrate sheet 2 is peeled off and is formed all over the surface. As a material for the ionizing radiation curing layer 4, there can be employed an active energy line curable resin such as an ultraviolet curing resin or an electron beam curing resin, or a thermosetting resin, or the like. Moreover, it is acceptable to add a pigment or dye as needed for coloring. As a method for forming the ionizing radiation curing layer 4, there are coating methods such as the gravure coating method, the roll coating method, and the comma coating method, and printing methods such as the gravure printing method and the screen printing method. Moreover, if the ionizing radiation curing layer 4 is a precuring type, it is proper to carry out ultraviolet ray or electron beam irradiation after drying the solvent. Moreover, if the ionizing radiation curing layer 4 is an after-curing type, it is proper to carry out ultraviolet ray or electron beam irradiation after transfer or transfer simultaneous with molding. Regarding the ionizing radiation curing layer 4, the expression of "all over the surface" or "wholly" implies that the ionizing radiation curing layer 4 may be no formed on any portion that is not utilized after the slitting.

The patterned layer 5 may be laminated all over the surface of the ionizing radiation curing layer 4 (see FIG. 2), or it may be partially laminated (see FIG. 1). The patterned layer 5 is normally formed as a print layer. As a material for the print layer, it is proper to employ a resin such as a polyvinyl based resin, a polyamide based resin, a polyester based resin, an acrylic resin, a polyurethane based resin, a polyvinyl acetal based resin, a polyesterurethane based resin, a cellulose ester based resin, or an alkyd resin as a binder and employ a coloring ink that contains a pigment or dye of an appropriate color as a coloring agent. As a method for forming the print layer, it is proper to use an ordinary printing method such as the gravure printing method, the screen printing method or the offset printing method. In particular, the offset printing method and the gravure printing method are appropriate for carrying out multicolor printing and half-toning. Moreover, in the case of a single color, it is acceptable to adopt a coating method such as the gravure coating method, the roll coating method, or the comma coating method.

Moreover, the patterned layer 5 may be constructed of a metal thin film layer or a combination of a print layer and a metal thin film layer. The metal thin film layer is to express metallic luster as the patterned layer 5 and is formed by the vacuum deposition method, the sputtering method, the ion plating method, the plating method, or the like. According to the metallic luster color desired to be expressed, a metal of aluminum, nickel, gold, platinum, chromium, iron, copper, tin, indium, silver, titanium, lead, zinc, or the like; or an alloy or a compound of these metals is employed. As one example of partially forming a metal thin film layer, there is a method for forming a solvent soluble resin layer in the portion that needs no metal thin film layer, thereafter forming a metal thin film all over the surface, and removing the unnecessary metal thin film together with the solvent soluble resin layer by carrying out solvent cleaning. Moreover, as another example, there is a method for forming a metal thin film all over the surface, subsequently forming a resist layer in the portion desired to be left, and then carrying out etching with acid or alkali.

In the case where the patterned layer 5 is formed, the ink, which constitutes the patterned layer 5, is formed partially (only within a range in which the patterned layer 5 overlaps with the mold release layer 3) with regard to the one that has a property of adhesion to the molding resin. The ink, which has no property of adhesion to the molding resin (including a metal vapor deposition layer), may be formed all over the surface.

Figure 20:
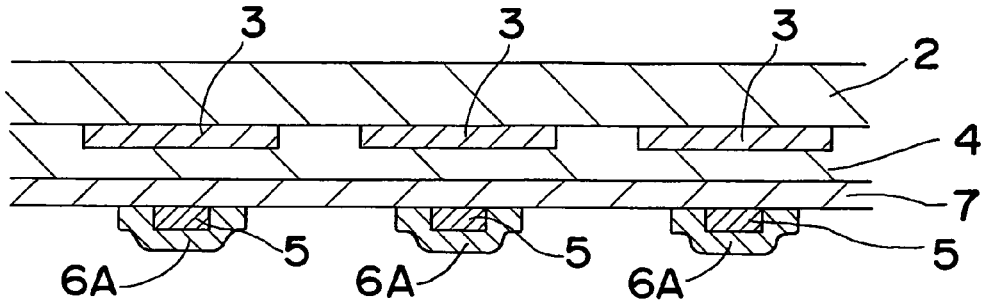
FIG. 20 is a sectional view of the transfer member of an embodiment of the present invention in which a region of the adhesive layer is narrower than a region of the peeling layer.

The adhesive layer 6 is to bond the aforementioned layers onto the surface of the object to receive transfer and is partially laminated only in the portion where the adhesive layer 6 overlaps with the mold release layer 3. The expression of "only in the portion where the adhesive layer 6 overlaps with the mold release layer 3" means the arrangement that the adhesive layer 6 is not located in the region where the mold release layer 3 is not formed. In other words, the reason why the adhesive layer 6 is formed "only in the portion where the adhesive layer 6 overlaps with the mold release layer 3" is that, if the adhesive layer 6 is formed in the portion where the adhesive layer 6 does not overlap with the mold release layer 3, then the substrate sheet 2 does not peel off the molding resin when the molding resin adheres. When the adhesive layer 6 is not made to completely coincide with the mold release layer 3 with regard to the positional relation (when formed in a smaller size as shown in FIG. 20), there is the allowance of: a minimum deviation of about 0.2 mm (print registration error) and a maximum deviation to the extent that the adhesive layer 6 does not overlap with the patterned portion 5 (depending on the demanded pattern and the film width). In such a manner, when, as shown in FIG. 20, the adhesive layer 6 is laminated in a region narrower along a direction of width of the transfer member than a region where the adhesive layer 6 overlaps with the mold release layer 3, it is preferable that the adhesive layer 6 is not laminated in a region other than the region overlapping with the mold release layer 3 even though print registration error may occur. For the adhesive layer 6, a heat-sensitive or pressure-sensitive resin appropriate for the material of the object to receive transfer is properly employed. It is proper to employ, for example, an acrylic resin when the material of the object to receive transfer is an acrylic resin. Moreover, when the material of the object to receive transfer is a polyphenylene oxide polystyrene based resin, a polycarbonate based resin, a styrene copolymer based resin, or a polystyrene based blended resin, it is proper to employ an acrylic resin, a polystyrene based resin, a polyamide based resin, or the like, which have an affinity for these resins. Furthermore, when the material of the object to receive transfer is a polypropylene resin, it is possible to employ a chlorinated polyolefin resin, a chlorinated ethylene-vinyl acetate copolymer resin, a cyclized rubber and a coumarone-indene resin. As a method for forming the adhesive layer 6, there are the coating methods such as the gravure coating method, the roll coating method, and the comma coating method; and the printing methods such as the gravure printing method and the screen printing method.

The thickness dimensions of the layers are exemplified in a working example as: the mold release layer of 1 μm; the ionizing radiation curing resin of 5 μm; the anchor layer of 2 μm; the patterned layer of 3 μm; and the adhesive layer of 2 μm.

In order to improve the adhesion between the aforementioned transfer layers, it is acceptable to provide an anchor layer 7 all over the surface or partially as needed. In particular, if the anchor layer 7 is formed between the ionizing radiation curing layer 4 and the patterned layer 5, the arrangement capable of protecting the molded article and the patterned layer 5 from chemicals is preferable (see FIG. 3). For the anchor layer 7, there can be employed, for example, a two-part curing urethane resin, a melamine or epoxy based thermosetting resin, a thermoplastic resin of a vinyl chloride copolymer resin, and so on. As a method for forming the anchor layer 7, there are the coating methods such as the gravure coating method, the roll coating method, and the comma coating method, and the printing methods of the gravure printing method and the screen printing method.

As described above, in the transfer member 1 where at least the belt-shaped mold release layer 3, the ionizing radiation curing layer 4, the patterned layer 5, and the adhesive layer 6 are formed on the substrate sheet 2, it is important in the first embodiment of the present invention that, after the transfer member 1 is bonded to a resin board, the transfer member 1 has a peel strength smaller than 50 N/m with respect to the resin board in the portion where the mold release layer 3 is not provided when the substrate sheet 2 is peeled off at an angle of 90° with respect to the resin board.

Figure 17:
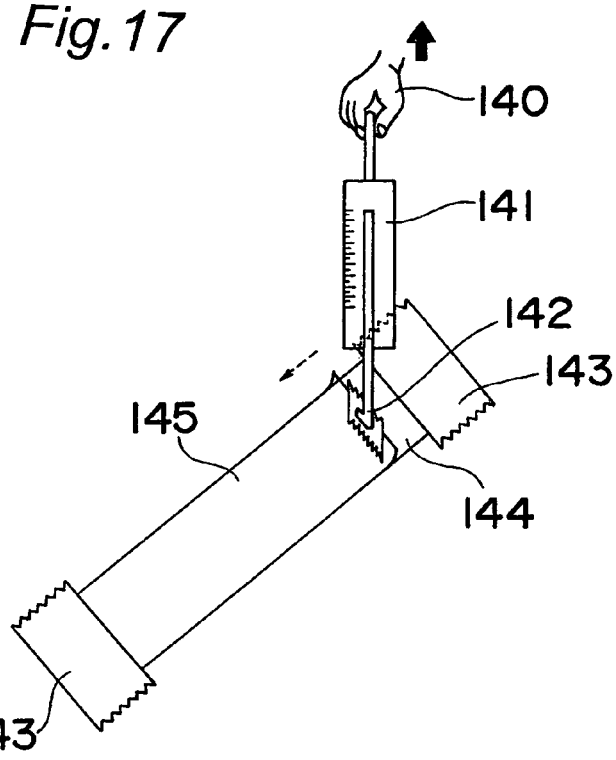
FIGS. 17 and 18 are explanatory views for explaining a peeling test for the transfer member of the embodiment of the present invention.
Figure 18:
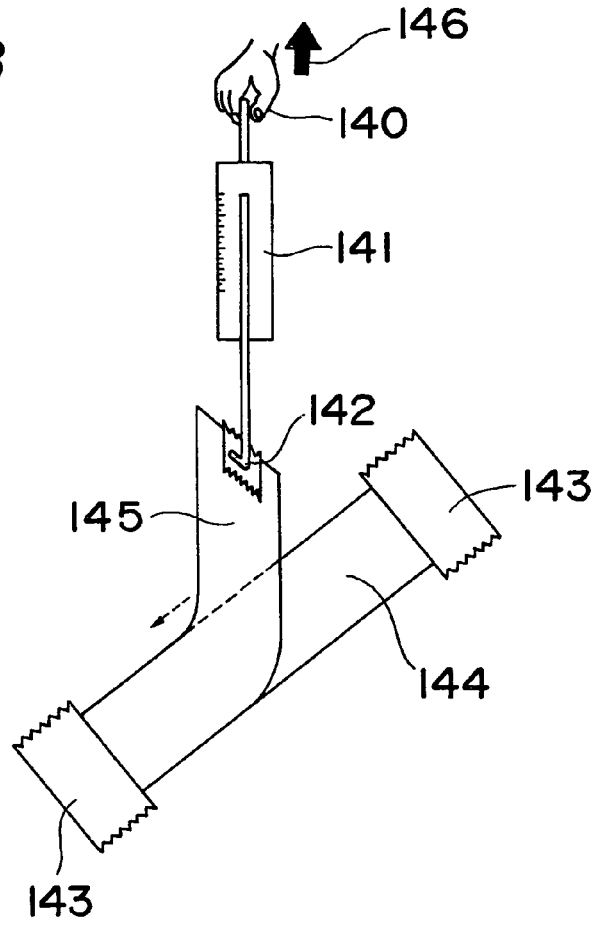
Figure 21:
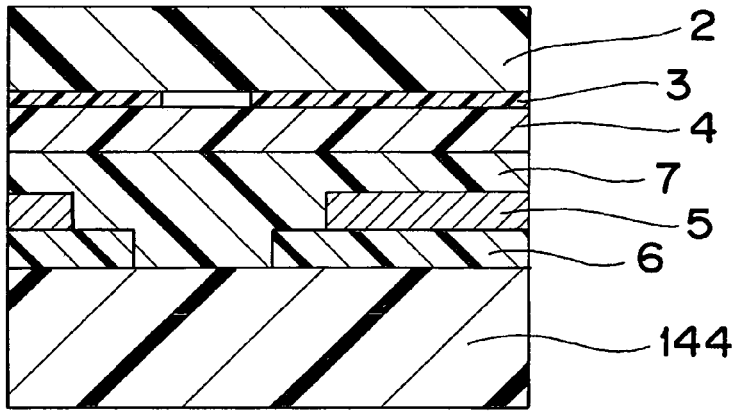
FIG. 21 is a sectional view of a state where the transfer member of an embodiment of the present invention is adhered to a resin board for the peeling test.

In order to measure the peel strength, the transfer member 1 (corresponding to 145 in FIGS. 17 and 18) is first bonded to a flat resin board 144 of the same material as that of the object to receive transfer by means of a roll transfer machine (See FIG. 21). There were the conditions of a transfer temperature of 220° C., a transfer pressure of 15 kN/m, and a transfer rate of 35 mm/sec. Subsequently, the resin board 144 is horizontally arranged by holding members 143 such as chucks as shown in FIG. 17, and a load (N) when the substrate sheet 2 is peeled off with the end portion thereof lifted upward (in the vertical direction shown by an arrow 146) at an angle of 90° by a hook 142 of a load measuring device 141 held with hand 140 is measured by the load measuring device 141. A value obtained by dividing the measured load (N) by the width (m) of the substrate sheet 2 that has been peeled off is assumed to be the peel strength (N/m). The peel strength depends on neither the size of the transfer member 1 nor the size of the resin board 144. The environmental temperature during the measurement was set at the ordinary temperature.

The reason why the peeling test is carried out at an angle of 90° is that the angle can be simply fixed constant. Note that it is difficult to keep an angle constant from the measurement start time to the measurement end time when the angle is 30° or 80°.

With regard to the resin board 144 used for the peeling test, there is used a resin for use in actual molding or a resin that has a property similar to this, the resin having a thickness of not smaller than 0.5 mm and a flat surface onto which at least the transfer member is bonded.

Figure 15:
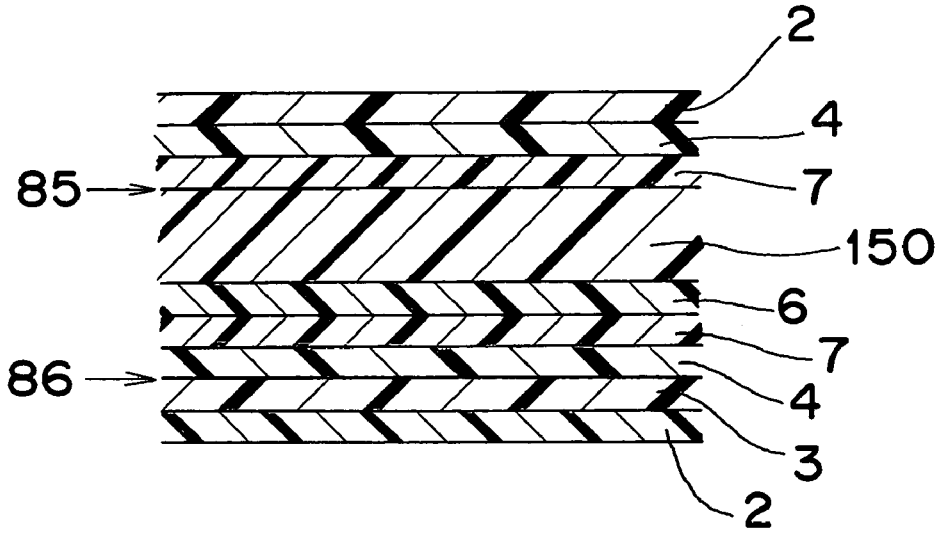
FIG. 15 is a sectional view of the transfer member of the first embodiment of the present invention at a portion A in FIG. 14.

As described above, by setting the peel strength smaller than 50 N/m, the sprue runner 213 for the molding resin communicating with a cavity 212 is to come in contact with the ionizing radiation curing layer 4 even when the sprue runner 213 comes in contact with the neighborhood of the slit portion 8 of the transfer member 1 during the transfer simultaneous with molding by injection molding as shown in FIG. 14. Therefore, the sprue runner 213 easily peels off, allowing the continuous molding to be carried out. That is, as shown in FIG. 15, in an injection molding state, a portion for mold-release is not only a portion 86 which is an interface of the mold release layer 3 for mold-release after transfer, but also a mold-release portion 85 on the sprue runner side of the molding resin portion 150 because of no adhesive layer, and thus, it is easy to release the sprue runner at this portion 85 for preventing the sprue runner from fusing to the adhesive layer. Note that in FIG. 14, reference numeral 80 denotes a region where the mold release layer 3 is provided, 81 denotes a region where the mold release layer 3 is not provided, and 82 denotes an arrow showing a flow of the molding resin.

Figure 22:
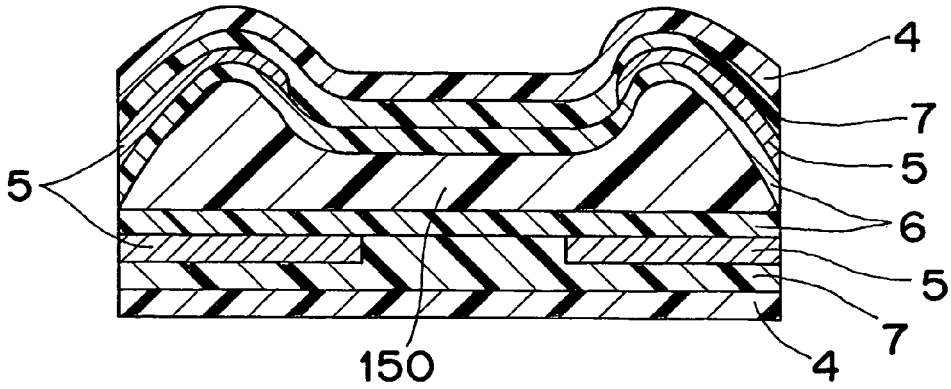
FIG. 22 a sectional view of a final product obtained by using the transfer member of an embodiment of the present invention.

The surface of the resin molding portion 150 of a resin molded article can be decorated by employing the transfer member 1 of the construction as described above. FIG. 15 and FIG. 22 show cases where the transfer members 1 are transferred to both surfaces of the resin molding portion 150 of the article. The resin molding portion 150 of the resin molded article may be transparent, translucent, or opaque and may be colored or not colored. As a resin, there can be enumerated general-purpose resins such as an acrylic resin, a polycarbonate resin, a polystyrene based resin, a polyolefin based resin, an acrylonitrile butadiene styrene resin, an acrylonitrile styrene resin, an acrylonitrile resin, and a polyamide resin.

A method for decorating the surface of the object to receive transfer employing the transfer member 1 of the aforementioned layer construction by using the transfer method will be described. First of all, the adhesive layer 6 side of the transfer member 1 is pressed against the surface of the object to receive transfer. Subsequently, by using a transfer machine such as a roll transfer machine or an up-down transfer machine equipped with a heat-proof rubber-like elastic body of silicon rubber or the like, heat and pressure are applied from the substrate sheet 2 side of the transfer member 1 via the heat-proof rubber-like elastic body set on the conditions of a temperature of about 80 to 260° C. and a pressure of about 490 to 1960 Pa. By this operation, the adhesive layer 6 is bonded to the surface of the object to receive transfer. Finally, if the substrate sheet 2 is peeled off after cooling, then peeling-off occurs at the interface between the mold release layer 3 and the ionizing radiation curing layer 4, completing the transfer.

A method for decorating the surface of a resin molded article that is the object to receive transfer by using the aforementioned transfer member 1 by utilizing the transfer simultaneous with molding by injection molding will be described next. First of all, the transfer member 1 is sent into the molding metal mold constructed of a movable die and a fixed die. In the above case, it is acceptable to send sheet-shaped transfer members 1 one by one or intermittently send the required portion of an elongated transfer member 1. When an elongated transfer member 1 is used, it is proper to make the registration of the patterned layer 5 of the transfer member 1 coincide with the registration of the metal mold by means of a feeder unit that has a positioning mechanism. Moreover, the transfer member 1 can be fixed constantly in the same position if the transfer member 1 is fixed by the movable die and the fixed die after the position of the transfer member 1 is detected by a sensor when the transfer member 1 is intermittently sent, and this arrangement is convenient since no misregistration of the patterned layer 5 occurs. After the metal mold is closed, a melted resin is injected from the gate and stuffed into the cavity 212 of the metal mold (see FIG. 14), and the object to receive transfer is formed simultaneously with bonding the transfer member 1 to the surface of the object. The resin molded article that is the object to receive transfer is cooled, and thereafter, the metal mold is opened to take out the resin molded article. Finally, by peeling off the substrate sheet 2, the transfer is completed.

The transfer member 1 has the construction in which the layer of poor adhesion to the molding resin serves as the outermost layer with regard to the portion where the mold release layer 3 is not provided in the neighborhood of the slit portion 8. Therefore, the sprue runner also smoothly peels off the end portion of the transfer member 1, causing no hindrance to the continuous molding. Moreover, since the ionizing radiation curing layer 4 can be laminated all over the surface, the thickness of the ionizing radiation curing layer 4 can easily be increased, and a molded article having a sufficient surface strength can be obtained.

FIRST WORKING EXAMPLE

A transfer member was obtained by using a polyethylene terephthalate film of a thickness of 38 μm as a substrate sheet, applying a mold release layer in a belt-shaped pattern, sufficiently curing the layer, subsequently forming an ionizing radiation curing layer all over the surface, and then successively forming an anchor layer, a patterned layer, and an adhesive layer partially in the portion where the mold release layer had been formed.

By using the transfer member obtained as described above and using an acrylic resin as a molding resin, molding simultaneous with decorating was carried out. As a result, there was able to be obtained a molded article, which has a high surface strength and in which the sprue runner brought in contact with the portion where no mold release layer had been provided smoothly peeled off the transfer member.

SECOND WORKING EXAMPLE

A transfer member was obtained by using a polyethylene terephthalate film of a thickness of 38 μm as a substrate sheet, applying a mold release layer in a belt-shaped pattern, sufficiently curing the layer, subsequently successively forming an ionizing radiation curing layer and an anchor layer all over the surface, and then successively forming a patterned layer and an adhesive layer partially in the portion where the mold release layer had been formed.

By using the transfer member obtained as described above and using an acrylic resin as a molding resin, molding simultaneous with decorating was carried out. As a result, there was able to be obtained a molded article, which has a high surface strength and in which the sprue runner brought in contact with the portion where no mold release layer had been provided smoothly peeled off the transfer member.

The present invention, which is constructed of the aforementioned construction, has the following effects.

The transfer member of the present invention is constructed so that the mold release layer of a belt-shaped pattern is laminated on the substrate sheet, the ionizing radiation curing layer is laminated all over the surface, the patterned layer is laminated all over the surface or partially, the adhesive layer is partially laminated only in the portion(s) where the adhesive layer overlaps with the mold release layer, and the transfer member has a peel strength smaller than 50 N/m with respect to the resin board in the portion(s) where the mold release layer is not provided when the transfer member is peeled off at an angle of 90° with respect to the resin board after being bonded to the resin board. This therefore allows the obtainment of a molded article that can be continuously molded by the method of transfer simultaneous with molding and is excellent in the surface strength.

Figure 7:
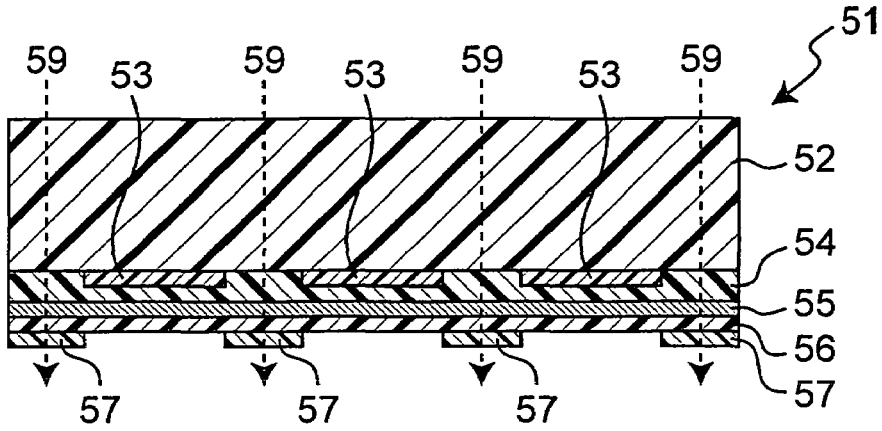
FIG. 7 is a sectional view showing a transfer member of a second embodiment of the present invention.
Figure 8:
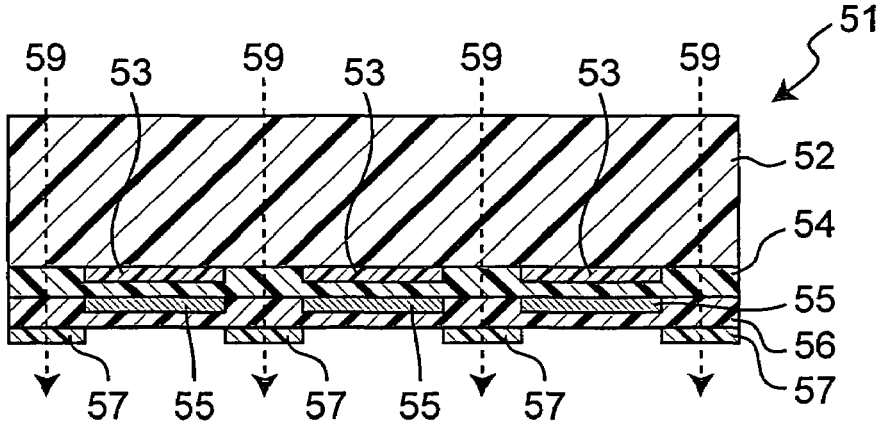
FIG. 8 is a sectional view showing the transfer member of a modification of the second embodiment of the present invention.
Figure 9:
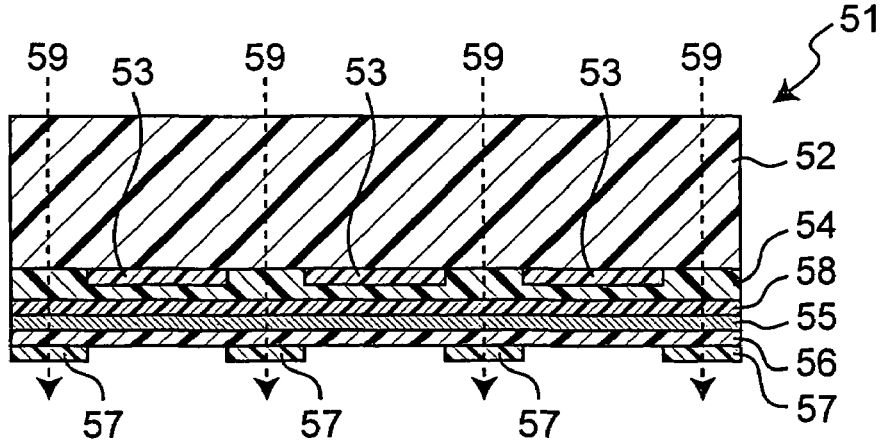
FIG. 9 is a sectional view showing the transfer member of another modification of the second embodiment of the present invention.

FIGS. 7 through 9 are sectional views showing transfer members of a second embodiment of the present invention and its modifications. In the figures, there are shown a transfer member 51, a substrate sheet 52 corresponding to the substrate sheet 2 of the transfer member of the first embodiment, a mold release layer 53 corresponding to the mold release layer 3 of the transfer member of the first embodiment, an ionizing radiation curing layer 54 corresponding to the ionizing radiation curing layer 4 of the transfer member of the first embodiment, a patterned layer 55 corresponding to the patterned layer 5 of the transfer member of the first embodiment, an adhesive layer 56 corresponding to the adhesive layer 6 of the transfer member of the first embodiment, a nonadhesive layer 57, an anchor layer 58 corresponding to the anchor layer 7 of the transfer member of the first embodiment, and a slit portion 59 corresponding to the slit portion 8 of the transfer member of the first embodiment.

The transfer member 51 has a construction in which the mold release layers 53 of belt-shaped patterns are partially laminated on the substrate sheet 52, the ionizing radiation curing layer 54 is laminated all over the surfaces of the substrate sheet 52 and the mold release layer 53, the patterned layer 55 is laminated all over the surface or partially, the adhesive layer 56 is laminated all over the surface(s), the nonadhesive layers 57 are partially laminated at least in a portion where the nonadhesive layers 57 do not overlap with the mold release layers 53, and the transfer member has a peel strength smaller than 50 N/m with respect to the resin board in the portions where the mold release layers 53 are not provided when the transfer member is peeled off at an angle of 90° with respect to the resin board after being bonded to a resin board (see FIG. 7).

The substrate sheet 52 is similar to the substrate sheet 2 of the transfer member of the first embodiment.

The mold release layer 53 is similar to the mold release layer 3 of the transfer member of the first embodiment.

The ionizing radiation curing layer 54 is similar to the ionizing radiation curing layer 4 of the transfer member of the first embodiment.

The patterned layer 55 is similar to the patterned layer 5 of the transfer member of the first embodiment.

The adhesive layer 56 is provided to bond the aforementioned layers onto the surface of the object to receive transfer and is laminated all over the surface. To the adhesive layer 56, there is properly applied a heat-sensitive or pressure-sensitive resin appropriate for the material of the object to receive transfer. It is proper to employ, for example, an acrylic resin when the material of the object to receive transfer is an acrylic resin. Moreover, when the material of the object to receive transfer is a polyphenylene oxide polystyrene based resin, a polycarbonate based resin, a styrene copolymer based resin, or a polystyrene based blended resin, it is proper to employ an acrylic resin, a polystyrene based resin, a polyamide based resin, or the like, which have an affinity for these resins. Furthermore, when the material of the object to receive transfer is a polypropylene resin, it is possible to employ a chlorinated polyolefin resin, a chlorinated ethylene-vinyl acetate copolymer resin, a cyclized rubber, or a coumarone-indene resin. As a method for forming the adhesive layer 56, there are the coating methods such as the gravure coating method, the roll coating method, and the comma coating method; and the printing methods such as the gravure printing method and the screen printing method.

The nonadhesive layer 57 is formed on the adhesive layer 56 at least in a portion(s) where the nonadhesive layer(s) 57 does not overlap with the mold release layer(s) 53. The "portion(s) where the nonadhesive layer(s) 57 does not overlap with the mold release layer(s) 53" means the arrangement that there may be a portion(s) where the nonadhesive layer(s) 57 is located in a region(s) where the mold release layer(s) 53 is formed. For the nonadhesive layer 57, it is proper to employ a resin that can be applied onto the adhesive layer 56 and does not closely adhere to the molding resin, by appropriate selection.

With regard to the portion where the nonadhesive layer 57 is formed, if the portion to which the mold release layer 53 is not applied is wholly covered with the nonadhesive layer 57, there occurs no such problem that the substrate sheet 52 does not peel off the molding resin. Note that the nonadhesive layer 57 is also permitted to be not applied to the portion to which the mold release layer 53 is not applied so long as the portion is not brought in contact with the sprue runner during molding. Therefore, the nonadhesive layer 57 is applied to the portion where the nonadhesive layer 57 does not overlap with the mold release layer 53 brought in contact with the sprue runner during molding. The nonadhesive layer 57 is not necessarily required to be "belt-shaped". The nonadhesive layer forming method is not limited to coating. If the thickness of the nonadhesive layer 57 is so thick that the thickness of the nonadhesive layer 57 exceeds 1 cm or in a similar case, then some problems will occurs during molding. As a method for determining the width of the region where the nonadhesive layer 57 is to be formed, it is desirable in consideration of print registration error that the width is properly determined within a range in which the width is 1-mm or more wider than the width of the region where the mold release layer 53 is not formed and 1-mm or more narrower than the width of the region where the pattern is not formed. As a method for forming the nonadhesive layer 57, there can be adopted a process for reducing the adhesive effect by UV, EB (Electron Beam), or the like at a portion where the nonadhesive layer 57 is to be formed after the adhesive layer 53 is wholly formed.

Moreover, it is acceptable to provide the anchor layer 58 all over the surface or partially in order to improve the adhesion between the aforementioned transfer layers as needed. In particular, if the anchor layer 58 is formed between the ionizing radiation curing layer 54 and the patterned layer(s) 55, the arrangement capable of protecting the molded article and the patterned layer(s) 55 from chemicals is preferable (see FIG. 9). For the anchor layer 58, there can be employed, for example, a two-part curing urethane resin, a melamine or epoxy based thermosetting resin, a thermoplastic resin of a vinyl chloride copolymer resin, and so on. As a method for forming the anchor layer 58, there are the coating methods such as the gravure coating method, the roll coating method, and the comma coating method; and the printing methods of the gravure printing method and the screen printing method.

As described above, in the transfer member 51 where at least the belt-shaped mold release layer 53, the ionizing radiation curing layer 54, the patterned layer 55, and the adhesive layer 56 are formed on the substrate sheet 52, it is important in the second embodiment of the present invention that, after the transfer member 51 is bonded to a resin board, the transfer member 51 has a peel strength smaller than 50 N/m with respect to the resin board in the portion(s) where the mold release layer(s) 53 is not provided when the transfer member 51 is peeled off at an angle of 90° with respect to the resin board.

In order to measure the peel strength, the transfer member 51 (corresponding to 145 in FIGS. 17 and 18) is first bonded to a flat resin board 144 of the same material as that of the object to receive transfer by means of a roll transfer machine. There were the conditions of a transfer temperature of 220° C., a transfer pressure of 15 kN/m and a transfer rate of 35 mm/sec. Subsequently, the resin board 144 is horizontally arranged by holding members 143 such as chucks as shown in FIG. 17, and a load (N) when the substrate sheet 52 is peeled off with the end portion thereof lifted upward (in the vertical direction shown by the arrow 146) at an angle of 90° by a hook 142 of a load measuring device 141 held with hand 140) is measured by the load measuring device 141. A value obtained by dividing the measured load (N) by the width (m) of the substrate sheet 52 that has been peeled off is assumed to be the peel strength (N/m). The peel strength depends on neither the size of the transfer member 51 nor the size of the resin board 144. The environmental temperature during the measurement was set at the ordinary temperature.

As described above, by setting the peel strength smaller than 50 N/m, the sprue runner 213 for the molding resin communicating with the cavity 212 is to come in contact with the nonadhesive layer 57 even when the sprue runner 213 comes in contact with the neighborhood of the slit portion 59 of the transfer member 51 during the transfer simultaneous with molding by injection molding as shown in FIG. 14. Therefore, the sprue runner 213 easily peels off, allowing the continuous molding to be carried out.

Figure 16:
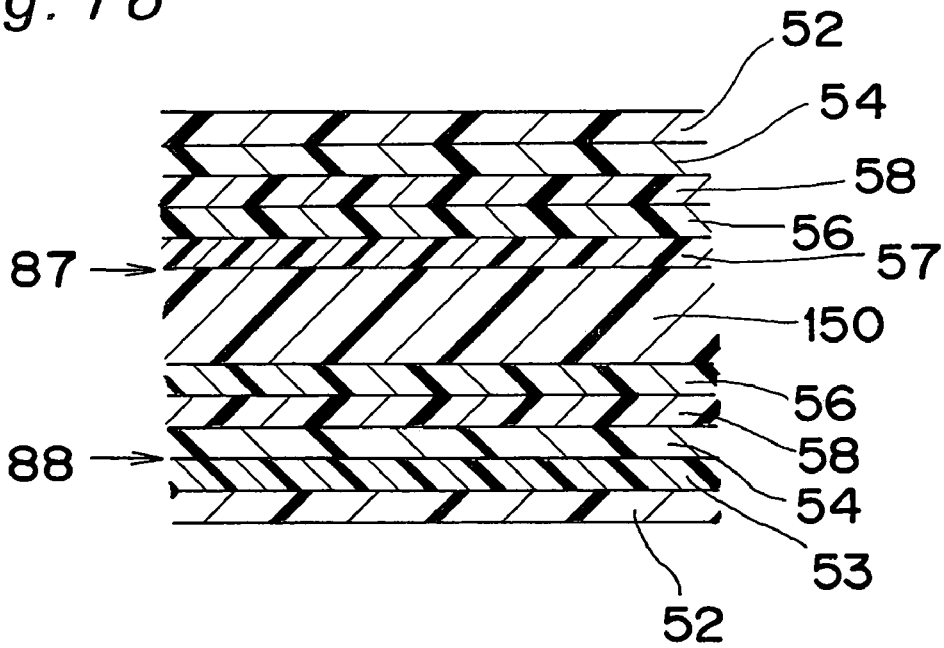
FIG. 16 is a sectional view of the transfer member of the second embodiment of the present invention at a portion A in FIG. 14.

That is, as shown in FIG. 16, in an injection molding state, a portion for mold-release is not only a portion 88 which is an interface of the mold release layer 53 for mold-release after transfer, but also a mold-release portion 87 on the sprue runner side of the molding resin portion 150 because of no adhesive layer 56, and thus, it is easy to release the sprue runner at this portion 87 for preventing the sprue runner from fusing to the adhesive layer.

The surface of the resin molding portion 150 of a resin molded article can be decorated by employing the transfer member 51 of the construction as described above. The resin molding portion 150 of the resin molded article is the same as that of the first embodiment. FIG. 16 shows a case where the transfer members 51 are transferred to both surfaces of the resin molding portion 150 of the article.

A method for decorating the surface of the object to receive transfer employing the transfer member 51 of the aforementioned layer construction by using the transfer method will be described. First of all, the adhesive layer 56 side of the transfer member 51 is brought into close contact with the surface of the object to receive transfer. Subsequently, by using a transfer machine such as a roll transfer machine or an up-down transfer machine equipped with a heat-proof rubber-like elastic body of silicon rubber or the like, heat and pressure are applied from the substrate sheet 52 side of the transfer member 51 via the heat-proof rubber-like elastic body set on the conditions of a temperature of about 80 to 260° C. and a pressure of about 490 to 1960 Pa. By this operation, the adhesive layer 56 is bonded to the surface of the object to receive transfer. Finally, if the substrate sheet 52 is peeled off after cooling, then peeling-off occurs at the interface between the mold release layer(s) 53 and the ionizing radiation curing layer 54, completing the transfer.

A method for decorating the surface of a resin molded article that is the object to receive transfer by using the aforementioned transfer member 51 by utilizing the transfer simultaneous with molding by injection molding will be described next. First of all, the transfer member 51 is sent into the molding metal mold constructed of a movable die and a fixed die. In the above case, it is acceptable to send sheet-shaped transfer members 51 one by one or intermittently send the required portion of an elongated transfer member 51. When an elongated transfer member 51 is used, it is proper to make the registration of the patterned layer 55 of the transfer member 51 coincide with the registration of the metal mold by means of a feeder unit that has a positioning mechanism. Moreover, the transfer member 51 can be fixed constantly in the same position if the transfer member 51 is fixed by the movable die and the fixed die after the position of the transfer member 51 is detected by a sensor when the transfer member 51 is intermittently sent, and this arrangement is convenient since no misregistration of the patterned layer 55 occurs. After the metal mold is closed, a melted resin is injected from the gate and stuffed into the metal mold, and the object to receive transfer is formed simultaneously with bonding the transfer member 51 to the surface of the object. The resin molded article that is the object to receive transfer is cooled, and thereafter, the metal mold is opened to take out the resin molded article. Finally, by peeling off the substrate sheet 52, the transfer is completed.

The transfer member 51 has the construction in which the layer of poor adhesion to the molding resin is served as the outermost layer with regard to the portion where the mold release layer 53 is not provided in the neighborhood of the slit portion 59. Therefore, the sprue runner also smoothly peels off the end portion of the transfer member 51, causing no hindrance to the continuous molding. Moreover, since the ionizing radiation curing layer 54 can be laminated all over the surface, the thickness of the ionizing radiation curing layer 54 can easily be increased, and a molded article having a sufficient surface strength can be obtained.

The present invention, which has the aforementioned construction, has the following effects.

The transfer member of the present invention is constructed so that the mold release layer(s) of a belt-shaped pattern(s) is laminated on the substrate sheet, the ionizing radiation curing layer is laminated all over the surface(s), the patterned layer(s) is laminated all over the surface or partially, the adhesive layer is laminated all over the surface, the non-adhesive layer(s) is partially laminated at least in the portion(s) where the nonadhesive layer(s) does not overlap with the mold release layer(s), and the transfer member has a peel strength smaller than 50 N/m with respect to the resin board in the portion(s) where the mold release layer(s) is not provided when the transfer member is peeled off at an angle of 90° with respect to the resin board after being bonded to the resin board. This therefore allows the obtainment of a molded article that can be continuously molded by the method of transfer simultaneous with molding and is excellent in the surface strength.

By properly combining arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A transfer member comprising:

a substrate sheet;

a mold release layer laminated on said substrate sheet, said mold release layer being constituted by a plurality of elongated mold release belt portions separated from one another so that a space is defined between each adjacent pair of said mold release belt portions;

an ionizing radiation curing layer laminated all over said mold release layer, and all over said substrate sheet in areas not covered by said mold release layer;

a patterned layer laminated on said ionizing radiation curing layer; and an adhesive layer laminated on said patterned layer in such a manner that said adhesive layer is located on said patterned layer only in areas that are superposed over said mold release belt portions of said mold release layer, such that said adhesive layer is not provided in areas not superposed over said mold release belt portions of said mold release layer.

2. The transfer member of claim 1, wherein said adhesive layer is laminated in areas that are respectively narrower than said mold release belt portions over which said adhesive layer is superposed.

3. The transfer member of claim 1, further comprising an anchor layer laminated between said ionizing radiation curing layer and said patterned layer.

4. The transfer member of claim 3, wherein said adhesive layer is laminated so as to be superposed over an entirety of each of said mold release belt portions of said mold release layer.

5. The transfer member of claim 1, wherein said adhesive layer is laminated so as to be superposed over an entirety of each of said mold release belt portions of said mold release layer.

6. A transfer member arrangement comprising a resin board, and a transfer member bonded to said resin board, said transfer member comprising:

a substrate sheet;

a mold release layer laminated on said substrate sheet, said mold release layer being constituted by a plurality of elongated mold release belt portions separated from one another so that a space is defined between each adjacent pair of said mold release belt portions;

an ionizing radiation curing layer laminated all over said mold release layer, and all over said substrate sheet in areas not covered by said mold release layer;

a patterned layer laminated on said ionizing radiation curing layer; and an adhesive layer laminated on said patterned layer in such a manner that said adhesive layer is located on said patterned layer only in areas that are superposed over said mold release belt portions of said mold release layer, such that said adhesive layer is not provided in areas not superposed over said mold release belt portions of said mold release layer;

wherein said transfer member has a peel strength smaller than 50 N/m with respect to said resin board in areas in which said mold release layer is not provided, when said substrate sheet is peeled off at an angle of 90° with respect to said resin board.

7. The transfer member arrangement of claim 6, wherein said adhesive layer is laminated in areas that are respectively narrower than said mold release belt portions over which said adhesive layer is superposed.

8. The transfer member arrangement of claim 6, further comprising an anchor layer laminated between said ionizing radiation curing layer and said patterned layer.

9. The transfer member arrangement of claim 8, wherein said adhesive layer is laminated so as to be superposed over an entirety of each of said mold release belt portions of said mold release layer.

10. The transfer member arrangement of claim 6, wherein said adhesive layer is laminated so as to be superposed over an entirety of each of said mold release belt portions of said mold release layer.

* * * * *